United States Patent [19]

Willnat et al.

[11] Patent Number: 4,927,389

[45] Date of Patent: May 22, 1990

[54] FIXTURE FOR MULTIPLE-CONTACT PIN HALOGEN LAMPS

[75] Inventors: Helmut Willnat; Manfred Meichsner, both of Kierspe, Fed. Rep. of Germany

[73] Assignee: Bender & Wirth GmbH & Co., Kierspe, Fed. Rep. of Germany

[21] Appl. No.: 298,594

[22] Filed: Jan. 18, 1989

[30] Foreign Application Priority Data

Jan. 19, 1988 [DE] Fed. Rep. of Germany ... 8800561[U]

[51] Int. Cl.[5] ..... H01R 13/00

[52] U.S. Cl. ..... 439/682

[58] Field of Search ..... 439/682–685, 439/817, 818

[56] References Cited

FOREIGN PATENT DOCUMENTS 538213 11/1931 Fed. Rep. of Germany ..... 439/817

616193 7/1935 Fed. Rep. of Germany ..... 439/817

*Primary Examiner*—Joseph H. McGlynn

*Attorney, Agent, or Firm*—Peter K. Kontler

[57] ABSTRACT

A fixture for halogen lamps of the type having two contact pins embodies a socket of insulating material. The socket is formed with two recesses which extend from its front to its rear side and receive contacts for the pins of the lamp. Each contact has a spring-biased plate bearing against a plate-like contact element forming part of a U-shaped connector having a bridge at the front or rear side of the socket and a hollow rivet in a passage of the socket. The rivets are connected to conductors by screws. Each connector constitutes a one-piece functional element of the fixture and performs several functions including anchoring and contact element in its recess and providing an electrical connection with the respective conductor.

23 Claims, 2 Drawing Sheets

FIXTURE FOR MULTIPLE-CONTACT PIN HALOGEN LAMPS

BACKGROUND OF THE INVENTION

The invention relates to fixtures for current consuming devices, especially to improvements in fixtures for halogen lamps or other radiation sources of the type having plural contact pins which must be connected with electric contacts.

Fixtures of the character to which the present invention pertains can be installed in lamp housings. Reference may be had, for example, to U.S. Pat. No. 4,569,568 granted Feb. 11, 1986 to Agabekov for "Adapter for tubular electric lamp fixture". A drawback of presently known fixtures is that they are bulky, complex and expensive. Furthermore, the task of connecting the contacts for the pins of the lamp to an energy source by way of wires is a time-consuming procedure. This is due to the fact that the wires must be connected to the poles of the energy source as well as to the respective contacts. Moreover, improper connections between the energy source and the contacts of a conventional fixture are not readily detectable so that, when the connection is improper, the entire fixture must be discarded.

OBJECTS OF THE INVENTION

An object of the invention is to provide a fixture which is constructed and assembled in such a way that the establishment of a mechanical connection between a support and the socket of the fixture automatically entails the establishment of a proper electrical connection between the energy source and the contacts for the pins c,f a halogen lamp or another source of radiation.

Another object of the invention is to provide novel and improved electrical connectors for use in a fixture of the above outlined character.

A further object of the invention is to provide a fixture wherein the electrical connectors can perform a plurality of different functions including the establishment of electrical connections with a selected energy source, the establishment of electrical connections with the terminals of a radiation source or another current-consuming part, and mechanical reinforcement of the fixture.

An additional object of the invention is to provide the fixture with novel and improved contacts for the contact pins of a radiation source.

Still another object of the invention is to provide a fixture which can be used as a superior substitute for heretofore known fixtures and which can be properly connected with a selected energy source in a simple and time-saving manner without any tools or by resorting to rudimentary tools.

Another object cf the invention is to provide the fixture with a novel and improved socket for contacts which can be engaged by the pins of a radiation source.

A further object of the invention is to provide the fixture with novel and improved fastener means for connection to bus bars or other types of conductors.

An additional object of the invention is to provide a novel and improved method of electrically connecting the pins of a halogen lamp or another radiation source with electrical conductors leading to an energy source.

SUMMARY OF THE INVENTION

The invention is embodied in a fixture for electric lamps, particularly for halogen lamps with several contact pins. The improved fixture comprises a socket having recesses for contact pins, and an electrical connector for each recess. At least one of the connectors comprises a contact element which is provided in one of the recesses and is engageable by a contact pin, a fastener element which is provide (e.g., embedded) in the socket, and an intermediate member which is integral with at least one of the elements. The socket can be provided with two recesses, and the fixture can further comprise a plurality of conductors (e.g., in the form of bus bars), one for each connector, and means for rigidly and conductively connecting the fastener element of the at least one connector with the respective conductor.

The at least one conductor can constitute a stamping or a turned part, i.e., a part which is produced in a lathe or in an analogous turning machine.

If desired, the at least one connector can constitute a film of conductive material which is applied to the socket.

The contact element of the at least one connector is or can be rigid, e.g., such contact element can constitute a plate. It is also possible to employ a springy contact element which bears against the contact pin in the one recess.

The socket includes a first or front side and a second or rear side opposite the first side. The recesses are arranged to receive contact pins of a lamp at the first side of the socket, and the intermediate member of the at least one connector can be adjacent one side of the socket, i.e., such intermediate member can be adjacent the first or front side or the second or rear side of the socket. It is also possible to design the at least one connector in such a way that its intermediate member is adjacent the peripheral surface of the socket.

The aforementioned means for conductively connecting the fastener element of the at least one connector to the respective conductor can comprise a threaded fastener. Such fastener can be replaced with means for frictionally connecting the fastener element with the respective conductor or with means for clamping the fastener element to the respective conductor.

The socket can be provided with a passage for the fastener element, and the one recess can form part of the passage. The passage can have a polygonal (particularly a substantially rectangular) cross-sectional outline, and the socket can be provided with two internal surfaces which surround selected portions of the passage. The fastener element is preferably adjacent one of the internal surfaces, and the fixture can further comprise resilient means (such as a prestressed coil spring) which reacts against the other internal surface and serves to bias a contact pin in the one recess against the contact element.

The fastener element can comprise an internally threaded hollow rivet, and the intermediate member can serve to connect one axial end of the hollow rivet with the contact element of the at least one connector. Such contact element can be provided with a contact surface which engages the contact pin in the one recess of the socket.

The at least one connector can constitute a mass-produced turned part which is made of a profiled bar or wire stock.

The novel features which are considered as characteristic of the invention are set forth in particular in the appended claims. The improved fixture itself, however, both as to its construction and the mode of using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
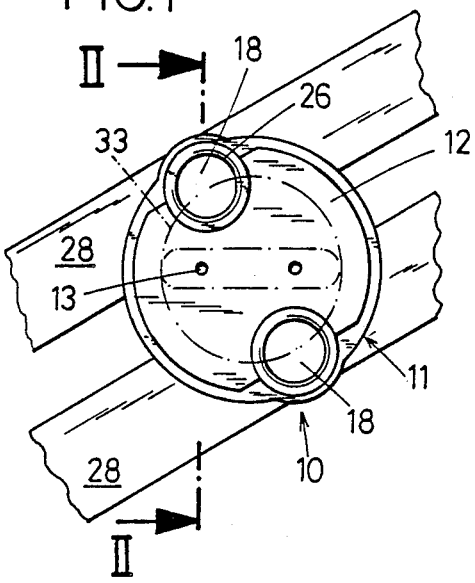
FIG. 1 is a plan view of a fixture which embodies one form of the invention and is connected to a source of electrical energy.
Figure 2:
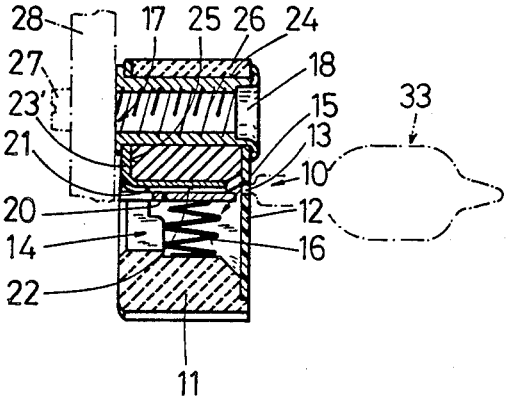
FIG. 2 is a sectional view as seen in the direction of arrows from the line II—II of FIG. 1.
Figure 3:
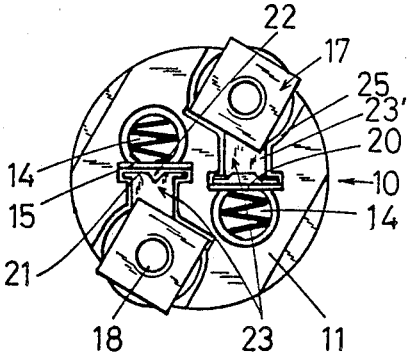
FIG. 3 is a rear elevational view of the socket of the fixture which is shown in FIGS. 1 and 2.
Figure 7:
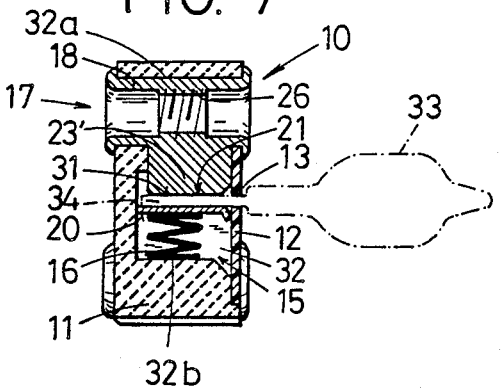
FIG. 7 is a sectional view as seen in the direction of arrows from the line VII—VII of FIG. 6.

The fixture 10 which is shown in FIGS. 1 to 3 comprises a substantially, cylindrical insulating socket 11 having a first or front side (shown in FIG. 1) and a second or rear side (shown in FIG. 3). The socket 11 serves to releasably support a halogen lamp 33 (indicated by broken lines in FIGS. 1, 2 and 7) having two contact pins 34 (FIG. 7). This socket is provided with two spaced-apart recesses 14 extending from its front side and receiving contacts 15 for the respective contact pins 34 of the lamp 33. The front side of the socket 11 has a shallow depression for a thin cover or lid 12 of an insulating material (such as mica) which overlies the open front sides of the recesses 14 and confines the contacts 15 therein. The cover 12 is held in its depression by two fasteners 17 including fastener elements in the form of rivets 18 which are anchored in the socket 11. The cover 12 has two spaced-apart openings 13 for the contact pins 34 of the lamp 33.

Each contact 15 comprises a mobile plate-like member 20, a fixedly mounted plate-like member (contact element) or stop 21, and a coil spring 16 which reacts against the internal surface of the respective recess 14 and tears against the mobile member 20 to urge the latter toward the contact element 21. That side or surface 31, called contact surface (FIG. 7), of each contact element 21 which confronts the plate-like member 20 has a groove or flute 22 for a portion of the respective contact pin 34. The flutes 22 serve to guide the respective contact pins 34 during attachment of the lamp 33 to the socket 11 of the fixture 10, and their depth is selected in such a way that each properly inserted contact pin 34 is reliably clamped between the respective contact element 21 and plate-like member 20. This is ensured by the respective coil spring 16.

In accordance with a feature of the invention, each fastener element 18 and the corresponding contact element 21 form parts of a one-piece connector 23 which further includes a bridge 23' recessed into the rear side or surface of the socket 11 (i.e., into that side which faces away from a properly inserted lamp 33) and constituting an intermediate member which is integral with the rivet-shaped fastener element 18 and with the plate-like contact element 21. Each connector 23 is a U-shaped metallic stamping with a web constituted by the intermediate member or bridge 23', a first leg constituted by the respective plate-like contact element 21, and a second leg constituted by the respective fastener element 18. The latter has an internal thread 26 and can be said to constitute the main part or section of the respective connector 23. The fastener element 18 establishes an electrical connection between the respective contact element 21 (i.e., between the respective contact pin 34 of a properly inserted lamp 33) and one of two supports including electrical conductors in the form of bus bars 28. The means for rigidly and conductively connecting the supports or conductors 28 to the corresponding rivet-shaped fastener elements 18 comprises screws 27 having shanks with external threads which mate with the internal threads 26 of the respective fastener elements 18. Each fastener element 18 is installed in a discrete passage 24 of the socket 11, and each such passage extends all the way between the front and rear sides or surfaces of the socket. The latter resembles a relatively short cylinder with a substantially circular cylindrical peripheral surface and two end faces (i.e., with front and rear surfaces). The intermediate member 23' of each connector 23 is disposed in a depression 25 in the rear side or surface of the socket 11 and is integral with the respective axial end of the corresponding fastener element 18. The depression 25 extends between the respective passage 24 and the respective recess 14. Each fastener element 18 ensures that the corresponding intermediate member 23' is properly retained in its depression 25 in the rear side or surface of the socket 11.

When the two contact pins 34 of a lamp 33 are properly inserted through the openings 13 of the cover 12 and into the respective recesses 14 so that they are confined between the plate-like members 20 and the contact elements 21 of the corresponding contacts 15, the lamp is properly connected with an energy source by way of the respective conductors 28, threaded connecting members 27, fastener elements 18, intermediate members 23' all contact elements 21.

Figure 4:
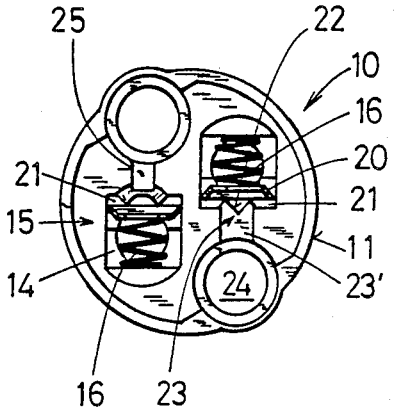
FIG. 4 is a front elevational view of the socket in a second fixture.

As mentioned above, the intermediate members 23' of the two connectors 23 are disposed at the rear sides or surfaces of the socket 11. FIG. 4 shows a modification wherein the intermediate members 23' of the two standings (connectors) 23 are recessed into the front side or surface of the socket 11. In all other respects, the fixture 10 of FIG. 4 is or can be identical with the fixture of FIGS. 1 to 3. The insulating cover (such as the cover 12 of FIG. 2) has been omitted in FIG. 4 in order not to conceal the contacts 15 in the respective recesses 14 of the socket 11. The depressions 25 are provided in the front side or surface of the socket 11 behind the depression for the cover.

Figure 5:
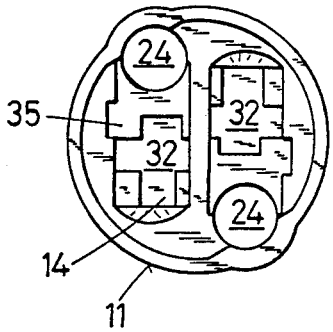
FIG. 5 is a front elevational view of the socket in a third fixture.
Figure 6:
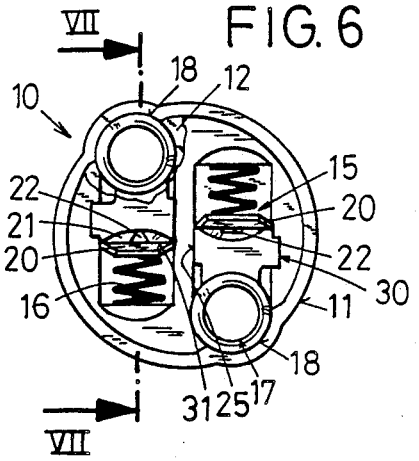
FIG. 6 illustrates the socket of FIG. 5 and the two electrical connectors of the third fixture.

FIGS. 5 to 7 show a third fixture 10 with a substantially cylindrical socket 11 of insulating material. This socket has two substantially polygonal (preferably substantially rectangular) channels 32 each of which extends between the front and rear sides or surfaces of the socket. Each channel 32 includes a passage 24 for the respective fastener element 18 and a recess 14 for the respective contact 15. Each contact 15 comprises a mobile plate-like member 20, a fixedly mounted contact element or stop 21 having a contact surface 31 with a groove or flute 22, and a coil spring 16 which biases the member 20 toward the respective contact element 21. The contact surface 31 of one of the contact elements 21 has a substantially triangular flute or groove 22, and the contact surface 31 of the other contact element 21 has another polygonal (e.g., rectangular) groove or flute 22. This ensures that each contact pin 34 of a halogen lamp 33 is in proper electrical contact with the respective element 21 in one of the two possible inserted positions of the lamp.

Each fastener element 18 forms part of a one-piece connector 30 which further includes the respective contact element 21 and a bridge or intermediate member 23' between the elements 18, 21.

Each fastener element 18 abuts one (**32*a*) of two spaced-apart internal surfaces 32*a*, 32*b* in the respective channel 32, and each coil spring 16 reacts against the other (32*b*) internal surface in the respective channel 32. As explained above, the springs 16 serve to permanently bias the plate-like members 20 toward the adjacent contact elements 21 of the respective contacts 15 to thus ensure that a properly inserted contact pin 34 is electrically connected with the respective connector 30**.

The provision of different polygonal (triangular and rectangular) grooves or flutes 22 in the two contact elements 21 ensures that the two contacts 14 can compensate for eventual manufacturing tolerances, e.g., for departures of the distance between the contact pins 30 of a halogen lamp 33 from an optimum or standard distance. It is preferred to provide the flutes 22 with outwardly flaring inlets for convenient introduction of the contact pins 34. This applies for all embodiments of the improved fixture.

Figure 8:
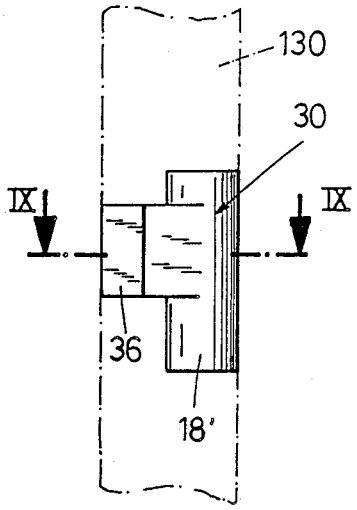
FIG. 8 is a side elevational view of a connector which is a turned part and is made of a bar or wire stock indicated by phantom lines.
Figure 9:
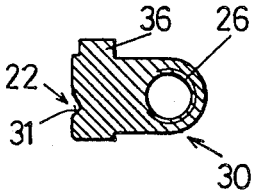
FIG. 9 is a sectional view as seen in the direction of arrows from the line IX—IX of FIG. 8.

FIGS. 8 and 9 illustrate by solid lines a connector 30 which is a turned part made from a length of metallic stock 130, e.g., a length of wire or bar stock. The illustrated connector 30 is provided with a portion 18' which is to be converted into a hollow rivet-shaped fastener element 18 with internal threads 26 for reception of the shank of a threaded connecting member 27 (FIG. 2), with a bridge or intermediate member 23', and with a plate-like contact element 21 having a contact surface 31 with a flute or groove 22 which, in the embodiment of FIGS. 8 and 9, has a substantially triangular cross-sectional outline.

The connector 30 of FIGS. 8 and 9 can be mass-produced in a standard machine tool and can be immediately provided with the internal thread 26 as well as with a properly finished contact surface 31 and a groove or flute 22 therein. Furthermore, the connector 30 has at least one male detent element or projection 32 which is receivable in a complementary female detent element or notch 35 (FIG. 5) forming part of the respective channel 32. This ensures that the orientation of a properly inserted connector 30 in the respective channel 32 of the socket 11 remains unchanged.

The ends of the tubular portion which surrounds the thread 26 are upset upon insertion of the connector 30 into the respective channel 32 of a socket 11 so that one end of the resulting rivet-shaped fastener element 18 overlies the cover 12 and the other end overlies the respective side or surface of the socket 11. This ensures that the connector 30 is adequately anchored in the socket 11, that the connector 30 reliably connects the cover 12 to the socket 11, as well as that the bridge or intermediate member 23' of the connector 30 is properly received in the respective depression 25 of the socket 11 so that the contact element 21 is properly oriented with reference to the respective plate-like member 20 of the corresponding contact 15. The manner in which the internal thread 26 is cut into the blank which is to be converted into a connector 30 forms no part of the invention.

The male detent elements 36 are machined in the turning tool, i.e., they can be formed on the connector 30 at the time such connector is separated from a longer or shorter piece of metallic bar or wire stock 130.

The diameter of the socket 11 need not exceed 20 mm. The screws 27 can be said to constitute a means for rigidly and conductively connecting the two connectors 23 or 30 of a fixture 11 to the respective conductors 28 in such a way that the fixture 10 and the lamp 33 therein are maintained in a predetermined (selected) orientation. The orientation of the lamp 33 can be altered by changing the positions of the conductors 28.

The improved fixture is susceptible of many additional modifications without departing from the spirit of the invention. For example, the fixture 10 can be provided with a socket 11 having a non-circular (such as square, hexagonal, octagonal or other polygonal) outline. Furthermore, each of the connectors 23 or 30 can be replaced by a connector constituting a film of conductive material which is deposited on the corresponding portions of the socket 11, i.e., each film can include a first section constituting an equivalent of a fastener element 18, a second section constituting an equivalent of a contact element 21, and a third section constituting an equivalent of an intermediate member 23'. Still further, the threaded connecting means 27 can be replaced with suitable pins or studs which are in reliable frictional engagement with the internal surfaces of the respective hollow rivet-shaped fastener elements 18 (such fastener elements need not be provided with internal threads). Alternatively, the screws 27 can be replaced with devices which clamp the fastener elements 18 or equivalent fastener elements to the respective conductors 28. An internally threaded nut or ring can be provided to separably secure the socket 11 to a housing for a lamp 33 or an analogous lamp and to simultaneously ensure the establishment of a reliable electrical connection between the fastener elements 18 (or analogous fastener elements) and the respective conductors leading to the poles of the energy source.

It is also within the purview of the invention to make the intermediate member 23' of a connector 23 or 30 integral with a pivotable contact element replacing the fixedly mounted contact element 21. For example, each contact element 21 can be made of a springy metallic material and can be connected to the respective intermediate member 23' by a rudimentary hinge so that it permanently tends to bear against a stationary plate-like contact member replacing the contact member 20. The springy contact element is then provided with a groove or flute for a portion of the respective contact pin 34. The aforementioned hinge can constitute a weakened portion of the respective connector, such weakened portion defining a pivot axis for the springy contact element. It is also possible to design the intermediate members 23' of the connectors 23 or 30 in such a way that they extend along the cylindrical or polygonal peripheral surface of the socket 11. All of the just enumerated modifications will be readily comprehended, without additional illustrations, by persons having the required skill in the relevant art.

An important advantage of the improved fixture is that its connectors 23 or 30 automatically establish reliable electrical connections between the bus bars 28 or other types of conductors leading to an energy source and the contacts 15 for the pins of a radiation source or another consumer of electrical energy which is separably coupled to the socket 11. In addition, the functional elements constituted by the connectors 23 or 30 reinforce or stabilize the entire fixture and render it possible to establish electrical connections for the contacts 15 in a time-saving mannel because it is not necessary to separately connect each contact 15 with a wire or with a like conductor. The connectors 23 or 30 cooperate with the screws 27 or with suitable substitutes (such as the aforementioned pins, studs or clamps) for such screws to ensure that the fixture is properly held in a selected orientation for the radiation source which is attached thereto. This obviates a time-consuming operation which is necessary in connection with conventional fixtures, namely the establishment of electrical connections between the contacts for the contact pins and the terminals of the fixture, i.e., those parts of a conventional fixture which are connected to conductors leading to an energy source. If the screws 27 are replaced with friction pins or with clamps, attachment of the fixture to bus bars 28 or to other types of conductors can be completed without resorting to any, even most rudimentary, tools.

Another important advantage of the improved fixture is that its appearance is more pleasing to the eye than the appearance of a conventional fixture. Thus, the contacts 15 are or can be fully confined and concealed in the respective recesses 14 of the socket 11, the socket can assume a desired (circular, polygonal or other) outline, the connectors 23 or 30 can be at least partly concealed in assembled condition of the fixture, and the means (such as the screws 27) for connecting the connectors 23 or 30 to an energy source are also hidden from view. The color of the socket 11 can be the dominant color of the fixture.

Still another important advantage of the improved fixture is that it comprises a small number of separately produced parts. Basically, the fixture comprises only a socket, a cover, two connectors (23 or 30), two springs (such as 16) which are optional because the contact elements 21 can be replaced with springy contact elements, two plate-like contact members 20, and means (such as simple screws 27) for connecting the connectors with an energy source. Thus, the improved fixture dispenses with numerous separately produced terminals, clamps, conductors, flat plugs, studs and like parts which contribute to complexity, cost and bulk of standard fixtures.

An additional important advantage of the improved fixture is that the likelihood of improperly connecting the contacts 15 with an energy source is practically nil. This is due to the fact that at least one part (contact element 21) of each contact 15 is an integral part of a one-piece connector which is directly connectable to a conductor (such as 28) leading to a pole of a suitable energy source. In other words, once the improved fixture is assembled, it is highly unlikely to be improperly connected to an energy source and it is equally unlikely to be improperly connected to the pins or analogous terminals of a radiation source or another consumer of electrical energy.

The making of connectors 23 or 30 in the form of stampings or turned parts contributes to their low cost and simplicity and renders it possible to mass-produce such connectors in available machines. The cost of the connectors can be reduced still further if they constitute the aforementioned films of conductive material which is directly applied to selected portions of the socket 11. Moreover, such film-shaped conductors contribute to a considerable reduction of the mass of the fixture and even further reduce the cost of assembling the fixture because it is not necessary to upset the ends of several rivets in order to adequately secure the cover 12 and the contact elements in the respective passages and recesses of the socket.

The feature that the contact elements 21 constitute integral parts of the respective connectors 23 or 30 also contributes to simplicity, compactness and reliability of the improved fixture. Thus, at least one part of each contact 15 is automatically located in an optimum position for engagement by a contact pin as soon as the connectors are installed in or applied to the socket 11. Moreover, each contact element 21 is automatically connected to a pole of the energy source as soon as the respective fastener element 18 is properly connected to a bus bar or the like.

The provision of intermediate members 23' adjacent the front or rear side of a socket 11 contributes to compactness of the fixture and ensures that the intermediate members can be readily concealed, either at the rear side of the socket or behind the cover 12. On the other hand, the provision of connectors with intermediate members which extend along the peripheral surface of the socket 11 enhances the sturdiness of the entire fixture and of the connectors because the dimensions of the intermediate members 23' can be selected practically at will. In addition, it is simpler to apply the intermediate members to the periphery of the socket 11 if the connectors 23 or 30 are replaced with connectors consisting of films of conductive material which covers selected portions of the socket.

The improved fixture can be used in instruments, appliances, control panels and elsewhere, and such fixture can be used in combination with one or more additional fixtures.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A fixture for current consuming devices, particularly for halogen lamps with plural contact pins, comprising a socket having recesses for contact pins; an electrical connector for each of said recesses, at least one of said connectors comprising a contact element provided in one of said recesses and engageable by a contact pin, a conductive fastener element provided in said socket, and an intermediate member integral with at least one of said elements and providing an electrical connection between said elements; support means including electrical conductors for said connectors; and means for connecting said fastener element to said support means so that the fastener element electrically connects said contact element with the respective conductor in response to connection of said fastener element to said support means.

2. The fixture of claim 1, wherein said socket has two recesses.

3. The fixture of claim 1, wherein said connecting means includes means for rigidly connecting said fastener element with the respective conductor.

4. The fixture of claim 1, wherein said at least one connector is a stamping.

5. The fixture of claim 1, wherein said at least one connector is a turned part.

6. The fixture of claim 1, wherein said at least one connector includes a film of conductive material on said socket.

7. The fixture of claim 1, wherein the contact element of said at least one connector is rigid.

8. The fixture of claim 7, wherein said rigid contact element includes a plate.

9. The fixture of claim 1, wherein the contact element of said at least one connector is springy to bear against the contact pin in said one recess.

10. The fixture of claim 1, wherein said socket has a first side and a second side opposite said first side, said recesses being arranged to receive contact pins at said first side and said intermediate member of said at least one connector being adjacent one of said sides.

11. The fixture of claim 10, wherein said intermediate member of said at least one connector is adjacent the first side of said socket.

12. The fixture of claim 10, wherein said intermediate member of said at least one connector is adjacent the second side of said socket.

13. The fixture of claim 1, wherein said socket has a peripheral surface and the intermediate member of said at least one connector is adjacent the peripheral surface of said socket.

14. The fixture of claim 1, wherein said connecting means includes means for threadedly connecting said fastener element to the respective conductor.

15. The fixture of claim 1, wherein said connecting means includes means for frictionally connecting said fastener element to the respective conductor.

16. The fixture of claim 1, wherein said connecting means includes means for clamping said fastener element to the respective conductor.

17. The fixture of claim 1, wherein said socket has a channel for said fastener element, said one recess communicating with said channel.

18. The fixture of claim 17, wherein said channel has a polygonal, particularly a substantially rectangular, cross-sectional outline.

19. The fixture of claim 17, wherein said socket has two internal surfaces surrounding portions of said channel, said fastener element being adjacent one of said internal surfaces and further comprising resilient means reacting against the other of said internal surfaces and arranged to bias a contact pin in said one recess against said contact element.

20. The fixture of claim 1, wherein said fastener element includes an internally threaded hollow rivet.

21. The fixture of claim 20, wherein said rivet has a first end and a second end, said intermediate member connecting one end of said rivet with said contact element.

22. The fixture of claim 21, wherein said contact element has a contact surface engaging the contact pin in said one recess.

23. The fixture of claim 1, wherein said at least one connector is a mass-produced turned part made of a profiled bar or wire stock.

* * * * *